US005987412A

United States Patent [19]

Breen

[11] Patent Number: 5,987,412

[45] Date of Patent: Nov. 16, 1999

[54] SYNTHESISING SPEECH BY CONVERTING PHONEMES TO DIGITAL WAVEFORMS

[75] Inventor: Andrew Paul Breen, Ipswich, United Kingdom

[73] Assignee: British Telecommunications public limited company, London, United Kingdom

[21] Appl. No.: 08/796,818

[22] Filed: Feb. 6, 1997

Related U.S. Application Data

[60] Division of application No. 08/537,803, Oct. 23, 1995, abandoned, which is a continuation-in-part of application No. 08/166,998, Dec. 16, 1993, abandoned, which is a continuation of application No. PCT/GB94/01688, Aug. 1, 1994.

[30] Foreign Application Priority Data

Aug. 4, 1993 [EP] European Pat. Off. ..... 93306219

[51] Int. Cl.[6] ..... G10L 5/02

[52] U.S. Cl. ..... 704/260; 704/258

[58] Field of Search ..... 704/260, 200, 704/201, 254, 249, 203, 258, 266, 269

[56] References Cited

U.S. PATENT DOCUMENTS

| | | | |
|---|---|---|---|
| 4,692,941 | 9/1987 | Jacks et al. | 704/260 |
| 4,862,504 | 8/1989 | Nomura et al. | 704/260 |
| 5,153,913 | 10/1992 | Kandefer et al. | 704/267 |
| 5,204,905 | 4/1993 | Mitome | 704/260 |
| 5,327,498 | 7/1994 | Hamon | 704/267 |
| 5,490,234 | 2/1996 | Narayan | 704/260 |

OTHER PUBLICATIONS

Nakajima et al, "Automatic Generation of Synthesis Units Based on Context Oriented Clustering", International Conference on Acoustics, Speech and Signal Processing 88, vol. 1, Apr. 11, 1988, New York, pp. 659–662.

Chen, "Identification of Contextual Factors for Pronunciation Networks", International Conference on Acoustics, Speech and Signal Processing 90, vol. 2, Apr. 3, 1990, Albuquerque, NM, pp. 753–756.

Sagisaka, "Speech Synthesis by Rule Using an Optimal Selection of Non–Uniform Synthesis Units", International Conference on Acoustics, Speech and Signal Processing 88, vol. 1, Apr. 11, 1988, New York, pp. 679–682.

Seung Kwon Ahn et al, "Format Locus Overlapping Method to Enhance Naturalness of Synthetic Speech", Journal of the Korean Institute of Telematics and Electronics, vol. 28B, No. 10 Sep. 1991, Korea (see Abstract).

Emerard et al, "Base de Donnees Prosodiques Pour la Synthese de la Parole", Journal Acoustique, vol. 1, No. 4, Dec. 1988, France, pp. 303–307.

*Primary Examiner*—Richemond Dorvil
*Attorney, Agent, or Firm*—Nixon & Vanderhye P.C.

[57] ABSTRACT

Synthetic speech is generated by production of a digital waveform from a text in phonemes. A linked database is used which comprises an extended text in phonemes and its equivalent in the form of a digital waveform. The two portions of the database are linked by a parameter which establishes equivalent points in both the phoneme text and the digital waveform. The input text (in phonemes) is analyzed to locate a matching portion in the phoneme portion of the database. This matching utilizes exact equivalence of phonemes where this is possible; otherwise relation between phonemes is utilized. The selection process identifies input phonemes in context whereby improved conversions are obtained. Having analyzed the input exit into matching strings in the input form of the database beginning and ending parameters for the sections are established. The output text is produced by abutting sections of the digital waveform and defined by the beginning and ending parameters.

5 Claims, 1 Drawing Sheet

SYNTHESISING SPEECH BY CONVERTING PHONEMES TO DIGITAL WAVEFORMS

This is a division of application Ser. No. 08/537,803, filed Oct. 23, 1995, now abandoned, which is a continuation-in-part of application Ser. No. 08/166,998 filed Dec. 16, 1993 now abandoned, which is a continuation of PCT/GB94/01688 filed Aug. 1, 1994.

BACKGROUND OF THE INVENTION

1. Field of the Invention

This invention relates to synthetic speech and more particularly to a method of synthesising a digital waveform from signals representing phonemes.

2. Related Art

There are many circumstances, eg. in telephone systems, where it is convenient to use synthesised speech. In some applications the starting point is an electronic representation of conventional typography, eg. a disk produced by a word processor. Many stages of processing are needed to produce synthesised speech from such a starting point but, as a preliminary part of the processing, it is usual to convert the conventional text into a phonetic text. In this specification the signals representing such a phonetic text will be called "phonemes". thus this invention addresses the problem of converting the signals representing phonemes into a digital waveform. It will be appreciated that the digital waveforms are commonplace in audio technology and digital-to-analogue converters and loud speakers are well known devices which enable digital waveforms to be converted into acoustic waveforms Many processes for converting phonemes into digital waveforms have been proposed and it is conventional to do this by means of a linked database comprising a large number of entries, each having an access portion defined in phonemes and an output portion containing the digital waveform corresponding to the access phonemes. Clearly all the phonemes should be represented in the access portions but it is also known to incorporate strings of phonemes in addition. However, existing systems only take into account the phoneme strings contained in the access portions and do not further take into account the context of the strings.

SUMMARY OF THE INVENTION

This invention, which is defined in the claims, uses a linked database to convert strings of phonemes into digital waveform but it also takes into account the context of the selected phoneme strings. The invention also comprises a novel form of database which facilitates the taking into account of the context and the invention also includes the method whereby the preferred database strings are selected from alternatives stored therein.

BRIEF DESCRIPTION OF THE DRAWINGS a preferred embodiment of the invention will now be described by way of example with reference to the accompanying drawings in which:

FIG. 1 illustrates diagrammatically a speech engine in accordance with this invention; and FIG. 2 shows a speech engine as illustrated in FIG. 1 attached to a telephone network.

DETAILED DESCRIPTION OF EXEMPLARY EMBODIMENTS GENERAL DESCRIPTION

Figure 1:
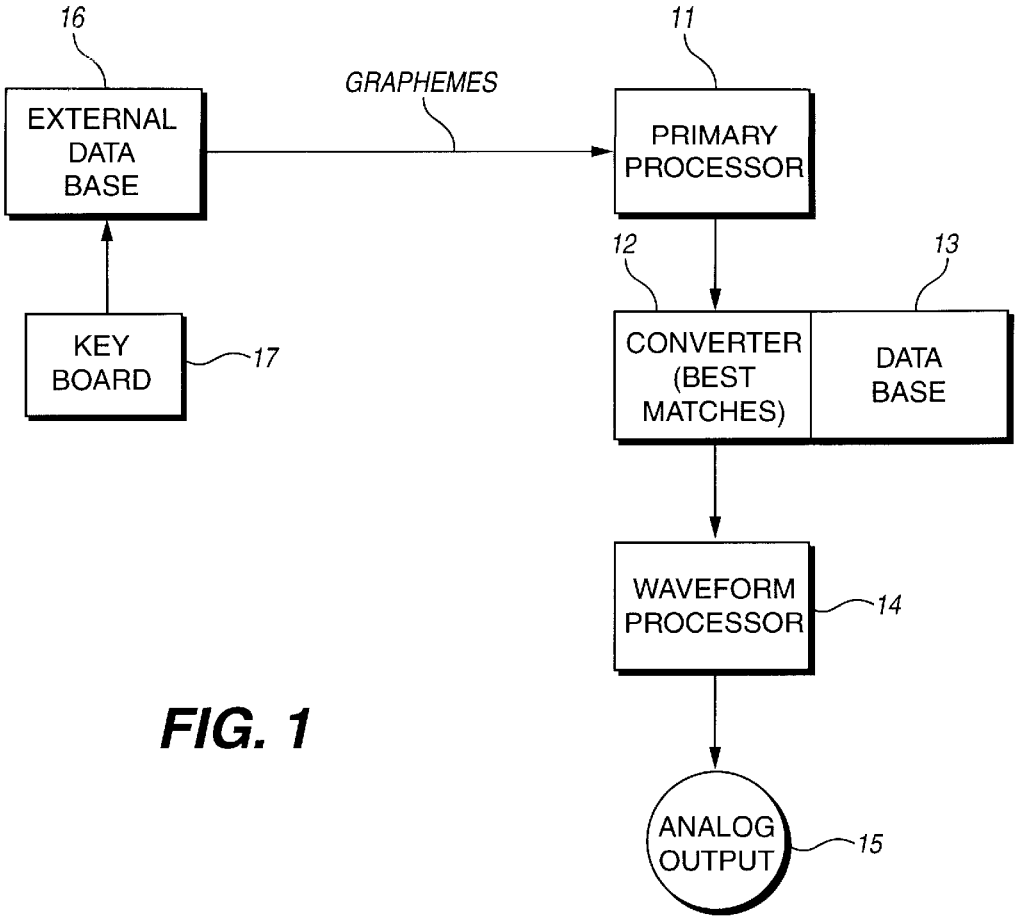

This general description is intended to identify some of the important integers of a preferred embodiment of the invention. Each of these integers will be described in greater detail after this general description.

The method of the invention converts input signals representing a text expressed in phonemes into a digital waveform which is ultimately converted into an acoustic wave. Before its conversion, the initial digital waveform may be further processed in accordance with methods which will be familiar to persons skilled in the art.

The phoneme set used in the preferred embodiment conform to the SAMP-PA (Speech Assessment Methologies—Phonetic Alphabet) simple set number 6. It is to be understood that the method of the invention is carried out in electronic equipment and the phonemes are provided in the form of signals so that the method corresponds to the converting of an input waveform into an output waveform.

The preferred embodiment of the invention converts waveform representing strings of one, two or three phonemes into digital waveform but it always operates on strings of five phonemes so that at least one preceding and at least one following phoneme is taken into account. This has the effect that, when alternative strings of five phonemes are available, the "best" context is selected.

It has just been explained that this invention makes particular use of a string of five phonemes and this string will hereinafter be called a "context window" and the five phonemes which constitute the "context window" will be identified as P1, P2, P3, P4 and P5 in sequence.

It is a key feature of this invention that a "data context window" being five consecutive phonemes from the input signal is matched with an "access context window" being a sequence of five consecutive phonemes contained in the database.

The prior art includes techniques in which variable length strings are converted into digital waveform However, the context of the selected strings is not taken into account. Each phoneme comprised in a selected string is, of course, in context with all the other phonemes of the string but the context of the string as a whole is not taken into account. This invention not only takes into account the contexts within the selected string but it also selects a best matching string from the strings available in the database. This specification will now describe important integers of preferred embodiment namely:

(i) the definition of "best" as used in the selections;

(ii) the configuration of the database which stores the signal representations of the data context windows together with their corresponding digital wave forms;

(iii) the method of selection for (ii) using (i); and (iv) picking one of the various alternatives provided by (iii).

DEFINITION OF "BEST"

This invention selects from alternative context windows on the basis of a "best" match between the input context window and the various stored context windows. Since there are many, e.g. $10^8$ or $10^{10}$ possible contexts windows (of 5 phonemes each) it as not possible to store all of them, i.e. The database will lack some of the possible context windows. If all possible context windows were stored it would not be necessary to define a "best" match since an exact correspondence would always be available. However, each individual phoneme should be included in the database and it is always possible to achieve an exact match for at least one phoneme, in the preferred embodiment it is always possible to match exactly P3 of the data context window with P3 of the stored context window but, in general, further exact matches may not be possible.

This invention defines a correlation parameter between two phonemes as follows. Corresponding to each phoneme there is a type-vector which consists of an ordered list of co-efficients. Each of these co-efficients represents a feature of its phoneme, e.g. whether its phoneme is voiced or unvoiced or whether or not its phoneme is a silibant, a plosive or a labil. It is also desirable to include locational features, eg whether or not the phoneme is in a stressed or unstressed syllable. Thus the type vector uniquely characterises its phoneme and two phonemes can be compared by comparing their type-vectors co-efficient by co-efficient; e.g. by using an exclusive-or gate (which is sometimes called an equivalence gate). The number of matchings is one way of defining the correlation parameter. If desired this can be converted to a percentage by dividing by the maximum possible value of the parameter and multiplying by 100.

(As an alternative, a mis-match parameter can be defined e.g. by counting the number of discrepancies in the two type vectors. It will be appreciated that selecting an "best" match is equivalent to selecting a lowest mis-match.)

The primary definition relates to the correlation parameter of a pair of phonemes. The correlation parameter of a string is obtained by summing or averaging the parameters of the corresponding pairs in the two strings. Weighted averages can be utilised where appropriate.

DATABASE

In the preferred embodiment, the database is based on an extended passage of the selected language, eg English (although the information content of the passage is not important). A suitable passage lasts about two or three minutes and it contains about 1000–1500 phonemes. The precise nature of fine extended passage is now particularly important although it must contain every phoneme and it should contain every, phoneme in a variety of contexts.

The extended passage can be stored in two different formats. First the extended passage can be expressed in phonemes to provide the access section of a linked database. More specifically, the phonemes representing the extended passage are divided into context windows each of which contains 5 phonemes. The method of the invention comprises obtaining best matches for the data context windows with the stored context windows just identified.

The extended passage can also be provided in the form of a digitised wave form. As would be expected, this is achieved by having a reader or reciter speak the extended passage into a microphone so as to make a digital recording using well established technology. Any point in the digital recording can be defined by a parameter, e.g. by the time from the start. Analysing the recording establishes values for the time-parameter corresponding to the break between each pair of phonemes in the equivalent text. This arrangement permits phoneme-to-waveform conversion for any included string by establishing the starting value of the time-parameter corresponding to the first phoneme of the string and the finishing value for the time-parameter corresponding to the last phoneme of the string and retrieving the equivalent portion of database, ie the specified digital waveform. Specifically a conversion for any string of one, two or three phonemes can be achieved.

The important requirement is to select the best portion of the extended text for the conversion.

It has already been mentioned that the phoneme version of the extended text is stored in the form of context windows each of five phonemes. This is most suitably achieved by storing the phonemes in a tree which has three hierarchical levels.

The first level of the hierarchy is defined by phoneme P3 of each window. The effect is that every phoneme gives direct access to a subset of the context windows ie. the totality of context windows is divided into subsets and each subset has she same value of P3.

The next level of the tree is defined by phonemes P2 and P4 and, since this selection is made from the subsets defined above, the effect is that the totality of context windows is further divided into smaller subsets each of which is defined by having phonemes P2, P3 and P4 in common. (There are approximately half a million subsets but most of them will be empty because the relevant sequence P2, P3, P4 does not occur in the extended text). Empty subsets are not recorded at all so that the database remains of manageable size. Nevertheless it is true that for each triple sequence P2, P3, P4 which occurs in the extended text there will be a subset recorded in the second level of the database under P2, P4 which level will also have been indexed at the first level under P3.

Finally the second level gives access to a third level which contains subsets having P2, P3 and P4 as exact matches and it contains all the values of P1 and P5 corresponding to these triples. Best matches for data P1 and P5 are selected. This selection completely identifies one of the context windows contained in the extended text and it provides access to time-parameters of said window. Specifically it provides start and finish time-parameters for up to four different strings as follows:

(a) P3 by itself;

(b) the pair of phonemes P2+P3;

(c) the pair of phonemes P3+P4; and (d) the triple consisting of the phonemes P2+P3+P4.

In the first instance, the database provides beginning and ending values of the time-parameter corresponding to each one of the selected strings (a)–(d). As explained above, the time-parameter defines the relevant portion of a digital wave form so that the equivalent wave form is selected.

It should be noted that item (d) will be offered if it is contained in the database; in this case items (a), (b), and (c) are all embedded in the selected (d) and they are, therefore, available as alternatives. If item (d) is not contained in the database then, clearly, this option cannot be offered.

Even if item (d) is missing from the database, then items (b) and/or (c, may still be present in the database. When both of these options are offered they will usually arise from different carts of the database because item (d) is missing. Therefore, depending on the content of the database, the selection will offer (b) alone, or (c) alone, or both (b) and (c). Thus the selection may provide a choice and in any case item (a) is available because it is embedded in the pair.

Finally, even if (b), (c) and (d) are all absent from the database, item (a) will always be present and thus "best match" will be offered for the single phoneme and this will be the only possibility which is offered.

It will be apparent that items (b), (c) and (d) imply that strings will overlap. Thus whenever item (c) is selected for any phoneme then item (b) must be available for the next phoneme. If nothing better offered, then the same part of the database will meet the requirements of (c) for the earlier phoneme and (b) for the later but because different correlations are involved better choices may be selected. It will also be apparent that whenever item (d) is available item (c) will be available for the previous phoneme and, in addition, item (b) will be available for the following phoneme. In other words, some of the strings will overlap, ie there will be alternatives for some phonemes such that the same phoneme occurs in different places in different strings. This aspect of the invention is described in greater detail below.

It has been emphasised that the preferred embodiment is based on a context window which is five phonemes long. However the full string of five phonemes is never selected. Even if, fortuitously, the input text contains a string of five found in the database only the triple string P2, P3, P4 will be used. This emphasises that the important feature of the invention is the selection of a string from a context and, therefore, the invention selects the "best" context window of five phonemes and only uses a portion thereof in order to ensure that all selected strings are based upon a context.

SELECTION OF "BEST" WINDOW

The analysis of the text into phonemes contained in the database is carried out phoneme by phoneme, but each phoneme is utilised in its context window. The next part of the description will be based upon the selection procedure for one of the data phonemes it being understood that the same procedure is used for each of the data phonemes.

The selected data phoneme is not utilised in isolation but as part of its context window. More precisely the selected data phoneme becomes phoneme P3 of a data window with us two predecessors and two successors being selected to provide the five phonemes of the relevant context window. The database described above is searched for this context window; since it is unlikely that the exact window will be located, the search is for the best fitting of the stored context windows.

The first step of the search involves accessing the tree described above using phoneme P3 as the indexing element. As explained above this gives immediate access to a subset of the stored context windows. More specifically, accessing level one by phoneme P3 gives access to a list of phoneme pairs which correspond to possible values of P2 and P4 of the data context-window. The best pair is selected according to the following four criteria.

First criterion. Fortuitously, it may happen that one pair in the sub-set gives an exact match for data P2 and P4. When this happens that pair is selected and the search immediately proceeds to level 3. This outcome is unlikely because, as explained in greater detail above, the string P2, P3, P4 may not be contained in the extended passage.

Second criterion. In the absence of a triple match a left pair will be selected if it occurs. The left-hand match is selected when an exact match for P2 is found and, if alternatives offer, the P4 which has the highest correlation parameter will be selected to give access to level 3 of the tree.

The third criterion is similar to the second except that it is a right-hand pair depending upon an exact match being discovered for P4. In this case access to level 3 is given by the P2 value which provides the highest correlation parameter.

Criterion four occurs when there is no match for either P2 or P3 in which the case the pair P2, P4 with the highest average correlation parameter is selected as the basis of access to level 3.

It will be noted that if criterion 1 succeeds, then it will be possible to take as alternatives a left-hand pair, a right-hand pair and a single value in accordance with criterion 2, 3 and 4.

Even if criterion 1 fails, it is still possible that a left-hand pair will be found by criterion 2 and it is even possible that, simultaneously, a right-hand pair will be found by criterion 3. However because criterion 1 has failed they will be selected from different parts of the database and they will give access to different parts of the tree at level 3.

Finally criterion 4 will only be accepted when criterion 1, 2 and 3 have all failed and it follows that the phoneme P3 cannot be found in triples or pairings when used in other context windows.

Thus, when criterion 1 or 4 are utilised there will only be access to one portion of the tree at the third level but it is possible, when criterion 2 and 3 are used that there will be access to two different parts of the third level.

We have now described how the selection of a context window gives rise to either one or two areas of the third level of the tree. In each case the third level may contain several pairings for phonemes 1 and 5 of the data context window. The pair with the best average correlation parameter is selected as the context window in the access portion of the database. As explained above this context window is converted to digital wave form using the time-parameter.

To re-emphasise; where criterion 1 is used only one context window is selected but it gives rise to four possibilities, namely time-parameter ranges for:

(i) the triple P2+P3+P4;

(ii) the left-hand pair P2+P3;

(iii) the right-hand pair P3+P4, and;

(iv) the single P3 by itself.

When criterion 2 operates, this provides time-parameter ranges only for the left-hand pair P2+P3 and for a single P3 by itself. When criterion 3 operates similar considerations apply but the parameter ranges are for the right-hand pair P2+P3 and for the single P4. If both criterion operate this offers two choices for the single P3 and only the one with the higher correlation parameter for P1+P5 is selected.

Finally when criterion 4 operates there only one possibility namely the phoneme P3 by itself.

The description given above explains how conversions are provided for each phoneme of an input text. Sometimes the method Provides a conversion for only a single phoneme and, in this case, no alternatives are offered. In some cases the method provides conversion for strings of two or three adjacent phonemes and, in these circumstances, the conversion provides alternatives for at least one phoneme. In order to complete the selection, it is necessary to reduce the number of alternatives to one. The preferred method of achieving this reduction will now be explained.

The preferred method of making the reduction is carried out by processing a short segment of input text, eg. a segment which begins and ends with a silence. Provided it is not too long a sentence constitutes a suitable segment. If a sentence is very long, e.g. more than thirty words, it usually contains one or more embedded silences, eg between clauses or other sub-units. In the case of long sentences such sub-units are suitable for use as the segments.

The processing of a segment to reduce each set of alternatives to one will now be described. As mentioned, no alternative will be offered for some of the phonemes and, therefore, no selection is required for these phonemes. Alternatives will be available for the other phonemes and the selection is made so as to produce a "best" result for the segment as a whole. This may involve making a locally "less good" selection at one point in the segment in order to obtain "better" selection elsewhere in the segment. The criteria of "better" include:

(i) taking longer strings rather than shorter strings, and (ii) selecting from strings which overlap rather than from strings which merely abut.

The rejection of unwanted alternatives produces a position in which each phoneme has one, and only one, conversion. In other words the input text will have been divided into sub-strings of 1, 2 or 3 phonemes matching the database and the beginning and ending values for the selected streams will therefore be established. The output portion of the database takes the form of a digitised waveform and the parameters which have been established define segments of this waveform. Therefore the designated segments are selected and abutted to produce the digital waveform corresponding to the input text. This completes the requirement of the invention.

Having obtained a digital waveform this can be provided as audible output using conventional digital to analogue conversion techniques and conventional loudspeakers. If desired, the primary digital waveform can be enhanced using techniques known to those skilled in the art.

As shown in FIG. 1 the speech engine according to the invention comprises primary processor 11 which is adapted to accept text in graphemes and to produce therefrom an equivalent text in phonemes. This text is passed to converter 12 which is operatively associated with a database 13 in accordance with the invention. Converter 12 best matches (as described above) matches segments of the phoneme text with segments stored in the access portion of database 13. Thus segments of digital waveform are retrieved and these are assembled into extended portions of digital waveform corresponding to extended portions of the original input.

These extended portions of digital waveform are passed to waveform processor 14 where they are subjected to further processing in order to produce a smooth output. Finally the digital output is converted into an analogue waveform which is provided at output port 15 for onward transmission.

As shown in FIG. 1 the speech engine is connected to receive its input from an external database 16 which holds texts in conventional orthography. External database 16 is conveniently operated by keyboard 17 to select a text stored in database 16. This text is provided into the primary converter 11 and it appears at the output port 15 as an analogue waveform.

Figure 2:
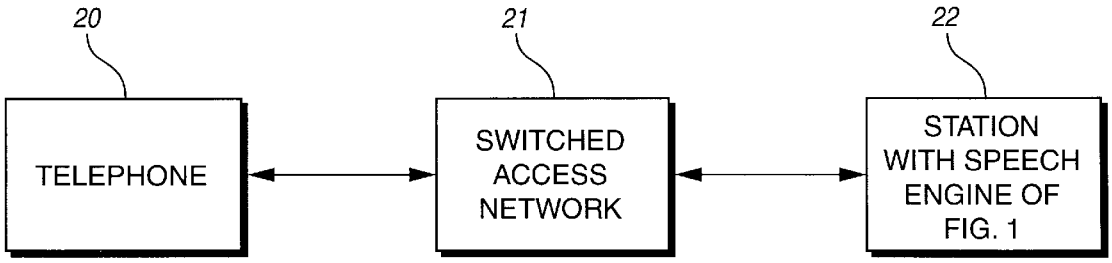

FIG. 2 shows a speech engine as illustrated in FIG. 1 attached to a public access telephone network. As shown in FIG. 2, a conventional speech telephone 20 is connected to a station 22 via a switched access network 21. Station 22 includes a speech engine as shown in FIG. 1 and the output port 15 is connected to the network so that the information available in the external database 16 can be provided, as an analogue acoustic waveform, to the telephone 20.

If desired the keypad (used for dialling) of the telephone 20 can be used as the keyboard 17 of the external database 16 (in which case the external database 16 preferably contains instructions which can be read by the speech engine). A simpler technical arrangement provides a human operator at the station 20 and the human operator actuates the keyboard 17 in accordance with instructions received over the network 21. When the operator has selected a portion of text this is read by the speech engine and further participation by the operator is unnecessary. Thus the operator is freed to assist with further enquires and the use of a speech engine enhances the efficiency of the operation.

It will be appreciated that there are many other applications for a speech engine according to the invention, e.g. It is suitable for connection to a public address system.

What is claimed is:

1. A database for use as a component of a speech engine said database comprising:

an output section containing an extended digital waveform, an access section containing signals representing said extended digital waveform in phonemes, and a common address parameter identifying common points in both sections, whereby identification of a segment of the signals representing said extended digital waveform in phonemes in the access section establishes beginning and ending values for the parameter and hence identifies the corresponding segment of the extended digital waveform.

2. A speech engine which comprises:

a primary processor for converting a text in graphemes into an equivalent text in phonemes, and a converter for converting said text in phonemes into a digital waveform, the converter including a database according to claim 1.

3. A telephone network which includes a speech engine according to claim 2, said speech engine being connected to the network for the transmission of the output of the speech engine to a remote location.

4. A database for use as a component of a speech engine said database comprising:

an output section containing an extended digital waveform, an access section containing signals representing said extended digital waveform in phonemes, and a common address parameter identifying common points in both sections. whereby identification of a segment of the signals representing said extended digital waveform in phonemes in the access section establishes beginning and ending values for the parameter and hence identifies the corresponding segment of the extended digital waveform;

the access portion contains windows of five phoneme length, said access section having a hierarchical higher level accessed by the center phoneme of a window to identify the second and fourth phonemes of a windows whereby entries in the higher hierarchical level are equivalent to strings of three phonemes, and said access portion also comprises a lower hierarchical level accessed by a string of three phonemes to identify the first and fifth phonemes whereby entries in the lower hierarchical level are equivalent to strings of five phonemes.

5. A speech engine which comprises:

a primary processor for converting a text in graphemes into an equivalent text in phonemes, and a converter for converting said text in phonemes into a digital waveform, the converter including a database according to claim 4.

* * * * *